US006260463B1

(12) United States Patent
Brand et al.

(10) Patent No.: US 6,260,463 B1
(45) Date of Patent: Jul. 17, 2001

(54) HAND-HELD PRIMER LOADING TOOL

(75) Inventors: Jerry D. Brand; Steven J. Koch; Steven R. Shields; Ronald L. Smith, all of Oroville, CA (US)

(73) Assignee: Blount, Inc., Montgomery, AL (US)

( * ) Notice: Subject to any disclaimer, the term of this patent is extended or adjusted under 35 U.S.C. 154(b) by 0 days.

(21) Appl. No.: 09/372,450

(22) Filed: Aug. 11, 1999

(51) Int. Cl.[7] ..... F42B 33/10

(52) U.S. Cl. ..... 86/37; 86/24; 86/32; 86/38; 86/44

(58) Field of Search ..... 86/23, 24, 32, 86/33, 36–38, 44

(56) References Cited

U.S. PATENT DOCUMENTS

| | | | | |
|---|---|---|---|---|
| 374,482 | * | 12/1887 | Lee | 86/38 |
| 3,107,575 | * | 10/1963 | Paul | 86/44 |
| 3,185,019 | * | 5/1965 | Shoffstall | 86/44 |
| 3,224,318 | | 12/1965 | Bachhuber . | |
| 3,319,511 | * | 5/1967 | McLean | 86/44 |
| 3,349,663 | | 10/1967 | Slee . | |
| 3,555,959 | * | 1/1971 | Lee | 86/37 |
| 3,636,812 | | 1/1972 | Nuler . | |
| 3,896,699 | | 7/1975 | Cerro . | |
| 3,973,465 | | 8/1976 | Bachhuber et al. . | |
| 4,142,441 | * | 3/1979 | Schaenzer | 86/37 |
| 4,222,305 | | 9/1980 | Lee . | |
| 4,331,063 | | 5/1982 | Schaenzer . | |
| 4,410,103 | | 10/1983 | Fuhrmeister . | |
| 4,425,833 | | 1/1984 | Purdie . | |
| 4,429,610 | | 2/1984 | Mantel . | |
| 4,841,831 | | 6/1989 | Bender et al. . | |
| 5,198,606 | | 3/1993 | Storstad et al. . | |
| 5,435,223 | | 7/1995 | Blodgett et al. . | |
| 5,693,905 | | 12/1997 | Blodgett et al. . | |
| 5,719,348 | | 2/1998 | Bill et al. . | |
| 5,767,433 | | 6/1998 | Bill et al. . | |

* cited by examiner

*Primary Examiner*—Harold J. Tudor
(74) *Attorney, Agent, or Firm*—Klarquist Sparkman Campbell Leigh & Whinston, LLP

(57) ABSTRACT

A hand-held tool for loading a primer into a primer socket of an ammunition cartridge case includes an elongate body with a holder for holding a cartridge case with its primer socket in a target position in a priming station. An elongate track on the tool longitudinally guides a rectilinear primer holding strip through the priming station. A reciprocating advancing member moves in advancing and retracting directions, and in its advancing direction engages the primer strip to sequentially align successive primers in the strip with the target position. A detent holds the primer strip against retraction when the advancing member moves in its retracting direction. A plunger is mounted for shifting longitudinally of the body into and away from the priming station to push a primer out of the primer strip into the primer socket of the cartridge. An elongate operator handle is connected to the body for movement relative thereto. Movement of the handle in one direction produces advancement of the primer strip to align a primer with the primer socket and shifting of the plunger out of the priming station. Movement of the handle in the opposite direction moves the plunger into the priming station followed by retraction of the advancing member. The cartridge case holder includes a pair of opposed, laterally spaced shiftable gripper members having arcuate gripping faces which are spring biased toward each other to hold the base of a cartridge case.

28 Claims, 5 Drawing Sheets

94
18
20
166
138b
34
82b
50
32
30
136b
42
82a
4A
5
130
5
116
128
100
120
132a
4A
146
162
164
160
132
142
150
48
154
146b
54
48b
48e
180
56a
14
56
58
12

18
30
42
28
108
24
108
138a
138b
80
82
78
66
68
120
100
114
112
12
142

HAND-HELD PRIMER LOADING TOOL

FIELD OF THE INVENTION

This invention relates generally to ammunition reloading systems, and more specifically to a hand-held system, or tool, for safely and conveniently loading primers into ammunition cartridge cases.

BACKGROUND OF THE INVENTION

Ammunition for firearms typically includes a bullet seated in a cartridge case. The case is a hollow cylinder with an open end sized to tightly hold the trailing edge of the bullet, and a socket, or base, end that receives a primer which contains a small amount of combustible material. When a firearm is discharged, a firing pin or hammer strikes the exposed end of the primer igniting the combustible material in the primer socket.

The primer ignites gunpowder inside the cartridge case to propel the bullet. The cartridge case remains intact after firing, with the spent primer wedged in the end of the case. The case may be discarded or reused.

Many firearm enthusiasts reload their ammunition to reduce cost, control quality of reloading, and to have the ability to customize ammunition. The ability to reload cartridge cases is particularly important to those who may fire numerous rounds during practice sessions. Reloading involves several steps, including removing the spent primer, reforming the case to a desired shape and size, and inserting a new primer into the empty primer socket. Devices have been developed in the past to perform all these functions, either sequentially or simultaneously on multiple casings.

U.S. Pat. No. 5,198,606 for example, discloses apparatus that removes the spent primer and pushes a replacement primer out of a disk-shaped holder to transfer the primer to the primer socket. The primers are in chambers aligned peripherally about an edge portion of the disk, and the disk is incrementally rotated to sequentially align target receptacles with a pusher pin that transfers the primer from the target receptacle to the primer socket.

The disk-shaped primer holder of the '606 patent provides a rigid structure that retains primers in an interference fit to minimize handling of the primers and improve safety. The disk may be removed and replaced when empty, however, it also is difficult to determine from the position of the disk how many of the primers have been unloaded because the disk is symmetric about its central rotation. The disk also inherently requires unused space toward the center of the disk that is unavailable for storing primers. Further, the '606 patent device is bench mounted, which does not provide the convenience and portability often desired which may be provided by a handheld tool.

U.S. Pat. No. 5,693,905 discloses bench mounted apparatus for advancing an elongate strip holding primers sequentially through the press for transferring primers from the strip to the cartridge case. Although the '905 device does permit reloading of primers from a rectilinear strip, as opposed to the disk-shaped primer holder of the '606 patent, it still is disclosed in the context of a bench mounted unit which does not provide the convenience and portability of a hand-held unit.

U.S. Pat. No. 5,435,223 discloses a form of hand-held cartridge priming device. However, it relies on a reservoir of loosely held primers which must be fed one-by-one through a channel to a priming station to be loaded into the cartridge primer socket. Loose primers such as this have a variety of disadvantages. The '223 patent attempted to cure a safety problem by providing a safety guard which could separate the single primer to be loaded into a cartridge case from other primers held in the feed channel and reservoir.

It is an object of this invention to provide an improved tool for inserting primers into ammunition cartridge cases, the tool being hand-held for convenience and portability and capable of using rectilinear priming holding strips.

Another object of the invention is to provide such a device that is easily and conveniently operated by a single hand of a user, such that gripping and releasing of a tool body and interconnected handle positions a primer in the primer holding strip in alignment with the primer socket of an ammunition cartridge, presses a primer from the primer holding strip into the primer socket, and upon release of the gripping pressure causes the primer plunger to retract and the primer holding strip to advance to position another primer in position to be loaded into the primer socket of a subsequent cartridge case.

A further object of the invention is to provide such a hand-held device that simply and efficiently reloads primers into spent cartridge cases.

Finally, it is an object of the present invention to provide a novel holder for receiving and holding the base of a cartridge case in a reloading process.

SUMMARY OF THE INVENTION

The foregoing objects are achieved by providing a hand-held tool for inserting a primer into an ammunition cartridge case having a primer socket. The tool includes a priming station having a holder that holds the cartridge case with its primer socket in a loading position. An elongate primer holding strip contains a plurality of longitudinally aligned primer receptacles, each holding a primer in an interference fit. An advancer incrementally longitudinally advances the elongate primer strip through the priming station sequentially to bring primer receptacles into a target position in the priming station. A punch, or plunger, member aligned with the receptacle in the target position then punches the primer out of the target receptacle and transfers the primer into the primer socket of a cartridge case occupying the adjacent loading position.

The punch member preferably includes a reciprocating pin that moves into and through the target receptacle to transfer the primer from the target receptacle to the primer socket. In a disclosed embodiment the advancer incrementally linearly advances the primer holder strip to align subsequent primers and subsequent target receptacles with a target position from which the primer is transferred to a target socket. The advancer is activated by moving a hand-gripped operating arm that reciprocates a sliding advancement member in a straight line along a straight track. Arms from the advancement member engage lateral projections along edges of the primer strip to incrementally move the strip in an advancing direction. The tool includes a body and an operating handle movable relative thereto, which are gripped between a user's fingers and the pad on the palm of the hand, such that the device may be operated by a user's single hand.

Being of a hand-held size, such that it may be held and operated by a single hand, it is conveniently maneuvered, operated and portable.

In a more detailed embodiment of the device, the tool includes retracting mechanism operable to retract the advancer to engage the primer holder strip and subsequently shift it in an advancing direction to place another primer in the target position. The mechanism for producing the retraction has a delay built in, such that retraction of the advancer is delayed until the plunger, or punch, member is advanced into the target position.

In a more detailed embodiment of the invention, the plunger comprises an elongate rod having a plunger head screwed thereon which has a multi-angular cross-sectional configuration which may be gripped by a wrench to attach and remove the plunger head from the rod without the need to remove the rod from the tool.

Further, the holder comprises a pair of opposed, laterally spaced shiftable gripper members having arcuate gripping faces and biasing mechanism yieldably biasing the gripping members toward each other to receive and hold the base of a cartridge case in the target position.

A better understanding of the invention will be had by reference to the following drawings and detailed descriptions.

DETAILED DESCRIPTION OF PREFERRED EMBODIMENT

Figure 1:
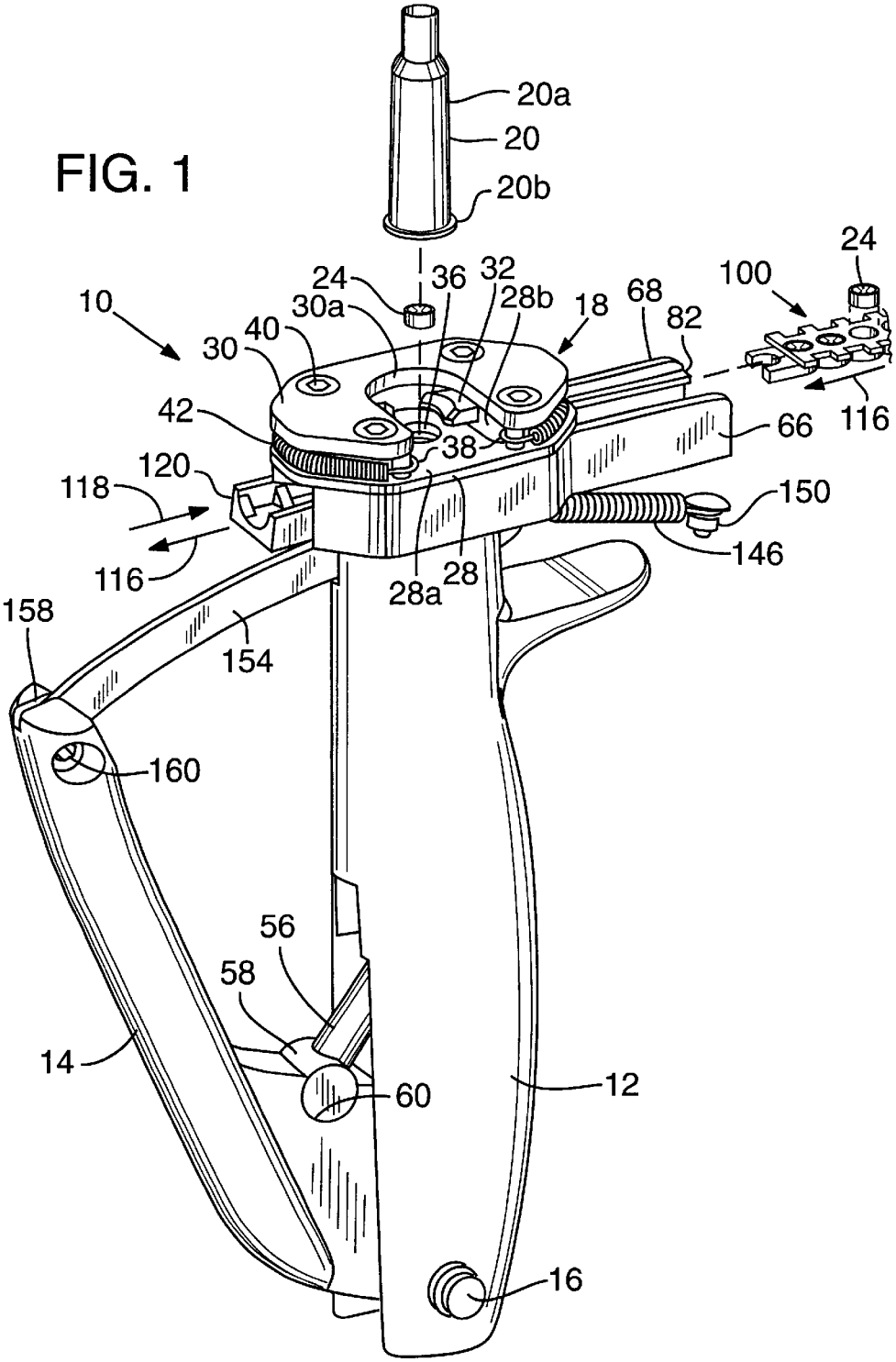
FIG. 1 is a perspective view of the assembled hand-held tool for inserting a primer into a cartridge case, showing the cartridge case and a primer thereabove.

Referring to the drawings, and first more particularly to FIGS. 1–4, at 10 is indicated generally a hand-held tool constructed according to a preferred embodiment of the present invention. The tool includes an elongate body 12 to which an elongate operating handle 14 is pivotally connected adjacent its lower end by pivot pin 16.

Mounted at the top, or upper end, of body 12 is a cartridge case holder 18 which receives and holds the base of a cartridge case. A cartridge case is indicated generally at 20 spaced above the tool in FIG. 1. As is known, the cartridge case includes a generally cylindrical hollow body 20*a* at the base, or lower, end of which is formed a projecting rim, or flange, 20*b*. Rim, or flange, 20*b* is circular and has a defined selected height. The base of the cartridge case has a primer receiving socket, or port, into which a primer, such as that indicated generally at 24, is inserted. The primer generally is inserted by being pressed into the socket in the base of the cartridge case and is held therein by an interference fit.

The cartridge case holder 18 includes a base plate 28, a top plate 30, and a pair of mirror image, opposed, laterally spaced apart gripping members 32, 34.

Describing base plate 28 in greater detail, it includes a substantially planar base portion 28*a* and a pedestal portion 28*b*. Base portion 28*a* has a bore 36 extending therethrough. Pedestal portion 28*b* has a substantially U-shaped opening formed therein which opens toward the viewer in FIG. 1 and away from the viewer in FIG. 2, and is substantially concentric with bore 36.

The top portion of pedestal 28*b* has a pair of aligned channels 28*c*, 28*d* formed therein which are configured to slidably receive gripping members 32, 34 therein respectively. A pair of posts 38 project upwardly from a base 28*a* adjacent what might be considered the in-feed mouth portion of pedestal 28*b*.

Top plate 30 is a substantially planar plate member having a U-shaped cutout 30*a* formed therein which overlies and is substantially coextensive with the U-shaped opening in base plate 28. A plurality of machine screws 40 extend through aligned vertical bores in base plate 28 and top plate 30 and into aligned threaded bores in underlying structures, as described in greater detail below, to secure the holder 18 together.

An elongate tension spring 42 underlying top plate 30 extends about the periphery of pedestal 28*b*. Spring 42 is stretched somewhat and has end hooks which hook about post 38. Gripping members 32, 34, received for sliding movement toward and away from each other in channels 28*c*28*d*, are urged inwardly toward the axis of bore 36 by spring 28.

Gripping members 32, 34, are substantially mirror images of each other. They are substantially planar elements having arcuate, or semi-circular, gripping faces 32*a*, 34*a* which are somewhat beveled. The semi-circular configuration is substantially complementary to the circular configuration of a cartridge and its base flange. As is best seen in FIG. 1, the forward edge of the gripping member (nearest the viewer in FIG. 1) is chamfered, such that it diverges from the opposing gripping member on progressing outwardly toward the viewer in FIG. 1 to facilitate insertion of the cartridge case.

Figure 3:
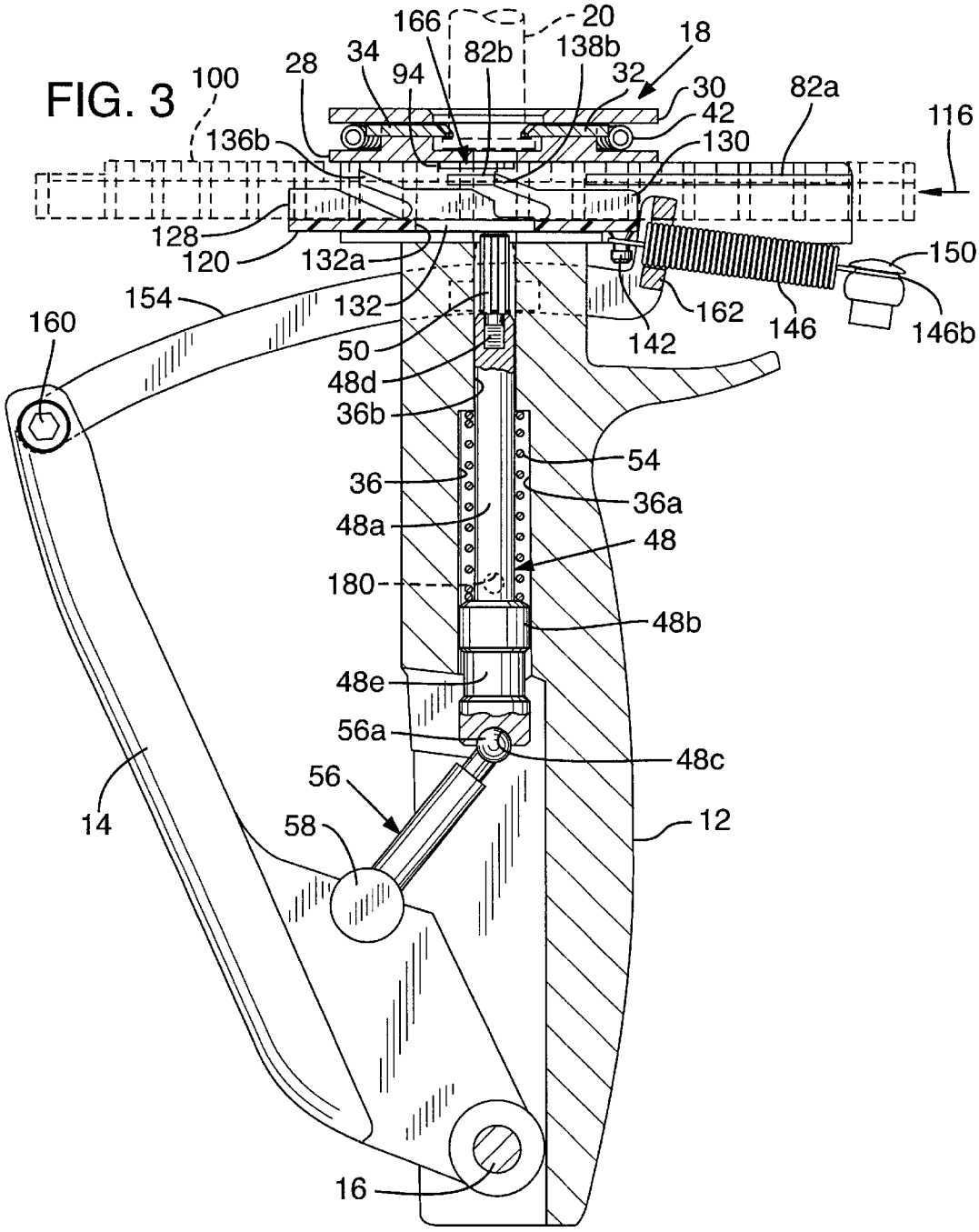
FIG. 3 is a cross section through the tool illustrated in FIG. 1 with a primer strip and cartridge case shown in dashed outline, with the operating handle for the unit in a released position.
Figure 4:
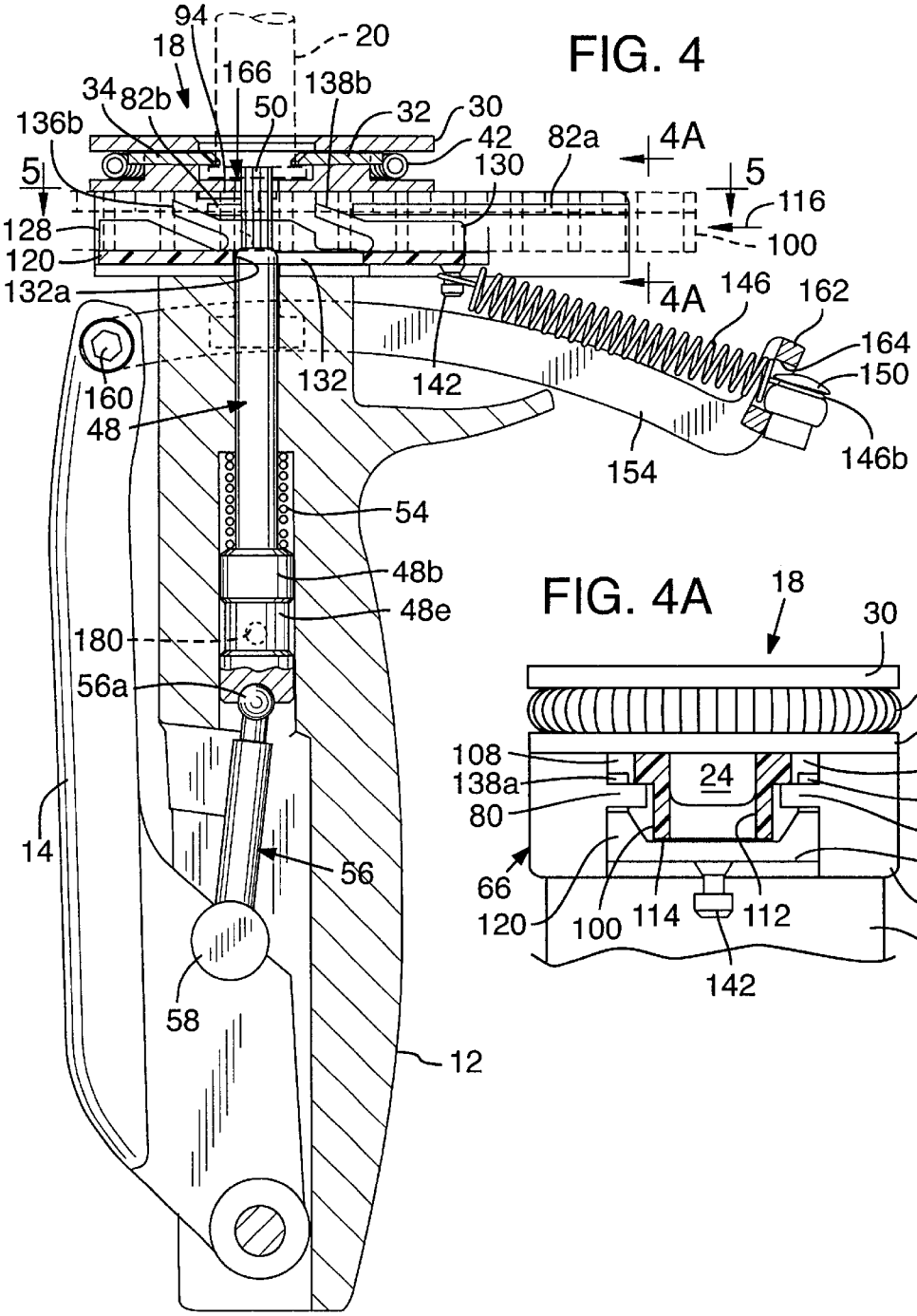
FIG. 4 is a view similar to FIG. 3 with the operating handle shown in a gripped, operative position.

As best seen in FIGS. 3 and 4, gripping members are supported in channels 28*c*, 28*d*, respectively, at a selected height above the base upon which the cartridge rests so that they are slightly higher than the height of flange 20*b*.

To insert a cartridge in the holder it is a simple matter to rest the base of the cartridge case on the top of base 28*a*, and slide it inwardly between gripping members 32, 34. The gripping members are urged yieldably outwardly against the tension of spring 42 until the cartridge is substantially centered over bore 36 and it is held therein by the gripping member.

Referring to FIGS. 3 and 4, tool body 12 has an elongate bore 36 extending longitudinally therethrough. This bore has a first diameter portion 36*a* and a second portion 36*b* of smaller diameter.

An elongate plunger, punch, or pin 48 is slidably mounted in bore 36 for shifting longitudinally of the body between a retracted, or non-operating, position as illustrated in FIG. 3, and an advanced, or operating, position as illustrated in FIG. 4, as will be described in greater detail below.

The upper portion 48*a* of the plunger has a diameter, which allows it to extend slidably through bore portion 36*b*.

The lower portion of the plunger 48*b* has an enlarged diameter, which can slidably move vertically in bore portion 36*a*, but would not slide into bore portion 36*b*.

The lower end of portion 48*b* of the plunger has a hemispherical concavity 48*c* formed therein.

Figure 2:
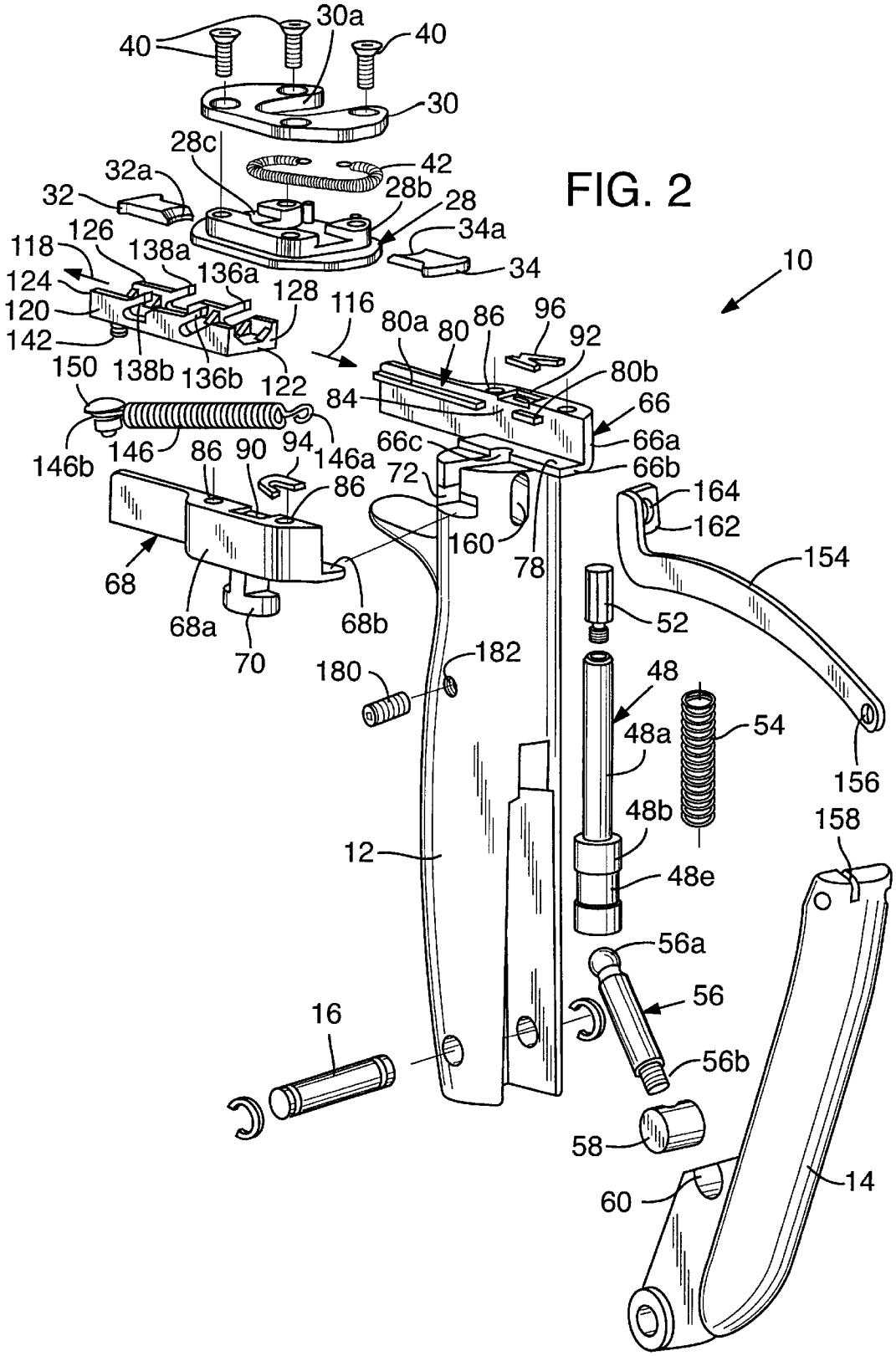
FIG. 2 is an exploded perspective view from a position opposite that illustrated in FIG. 1 illustrating the component parts of the tool.

A threaded bore 48*d* at the top of plunger 48 has a plunger head 50 screwed therein. As is best seen in FIG. 2, plunger head 50 has a multi-angular cross-sectional configuration adapted to be gripped by a wrench to be screwed into and out of plunger rod 48.

A compression spring 54 is interposed between the top of lower portion 48*b* of the plunger and the top, necked-down portion of bore section 36*b*, such that the spring urges plunger 48 downwardly toward the lower, retracted, or non-operating, position illustrated in FIG. 3. The spring is compressed as the plunger is shifted upwardly to the extended, or operating, position illustrated in FIG. 4. An elongate connecting, or operating, member 56 has a ball joint upper portion 56*a* which rests in concavity 48*c* in the base of plunger portion 48*b* and has a threaded lower end portion 56*b*.

A cylindrical element 58 has a threaded bore extending into one side thereof, which receives portion 56*b* of the connecting member. Handle 14 has a concave receiving region 60 formed therein intermediate its ends in which element 58 rotatably and loosely rests.

The interconnection and operation of parts thus described is such that when handle 14 is swung from a first position, spaced a selected distance outwardly from body 12, as illustrated in FIG. 3, toward its second position, as illustrated in FIG. 4, more closely adjacent body 12, connecting member 56 acts to push upwardly on plunger 48 against the urging of spring 54 to drive the plunger and plunger head upwardly toward cartridge case 20 held in the case holder 18.

Mounted atop body 12 are a pair of substantially mirror image track elements 66, 68. Track element 66 is formed as an integral part of body 12 and extends upwardly therefrom. Track element 68 has a substantially T-shaped joining portion 70 extending from the lower portion thereof which slides into a T-shaped slot 72 in the body so that track elements 66, 68 may mate in facing relationship, as shown in FIGS. 1 and 4A.

Since track elements 66, 68 are substantially mirror images of each other, only track element 66 will be described in detail. Referring to FIG. 2, the track element includes a major, upright elongate body portion 66*a*, and a substantially planar, horizontally disposed base portion 66*b*. The base portion has a semi-circular opening 66*c* formed therein which mates with a similar semi-circular opening in element 68 to form the upper portion of bore 36 in the body through which plunger 48 may extend.

Figure 4A:
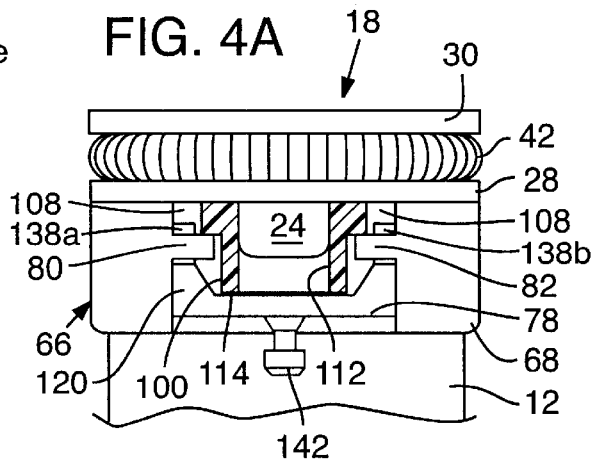
FIG. 4A is an enlarged view taken generally along the line 4A—4A in FIG. 4.
Figure 5:
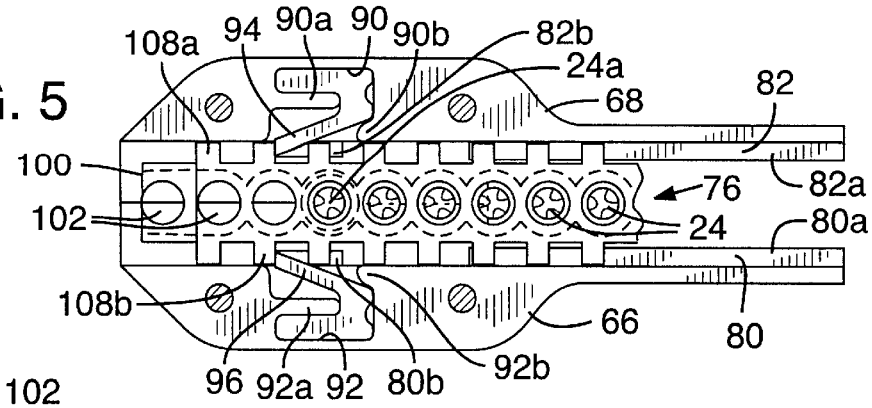
FIG. 5 is a view taken generally along the line 5—5 in FIG. 4.

As best seen in FIGS. 2, 4A and 5, the opposing track elements 66, 68 cooperatively form a linearly extending, rectilinear elongated track 76 extending transversely of body 12 that has a flat lower surface 78. A pair of opposing, parallel, rails, or ledges, 80, 82 project laterally inwardly from track elements 66, 68 and extend longitudinally along track 76, spaced above and parallel to lower surface 78. The rails are continuous, except for an interrupted section such as that indicated generally at 84 which separates the 10 rails into two segments such as that indicated generally at 80*a* and 80*b*. Rail section 80*b* also is referred to herein as a stop element.

When the parts illustrated in FIG. 2 are assembled as illustrated in FIG. 1, track elements 66, 68 are in mating contact along the facing edges of their lower section 66*b*, 68*b* and base plate 28 of the cartridge case holder rests atop track elements 66, 68. Threaded bores 86 in the tops of track elements 66, 68 receive machine screws 40 to secure the cartridge case holder 18 to the track elements, and thus to handle 12. Rails 80, 82 are spaced a selected distance below the tops of track elements 66, 68 so that a space is provided between the upper surfaces of the rails and the bottom of the cartridge case holder 28 which is sufficient to permit sliding of a primer holder strip therein, as will be described in greater detail below.

Referring still to FIGS. 2 and 5, the top regions of track elements 66, 68 have cutouts 90, 92 formed therein which open to the inner sides of the track elements. The cutouts have projections 90*a*, 92*a* and 90*b*, 92*b* formed therein to hold a pair of flexible detent arms 94, 96 as illustrated in FIGS. 2 and 5. The detent arms are flexible substantially flat V-shaped elements which are held in cutouts 90, 92 as illustrated in FIG. 5 with one portion thereof extending at an angle outwardly from its associated cutout and into the region between track elements 66, 68. These arms extend at an angle toward each other, progressing in what may be termed an advancing direction in the device as will be described in greater detail below. These detent arms also are held in their cutouts by overlying base plate 28.

Figure 6:
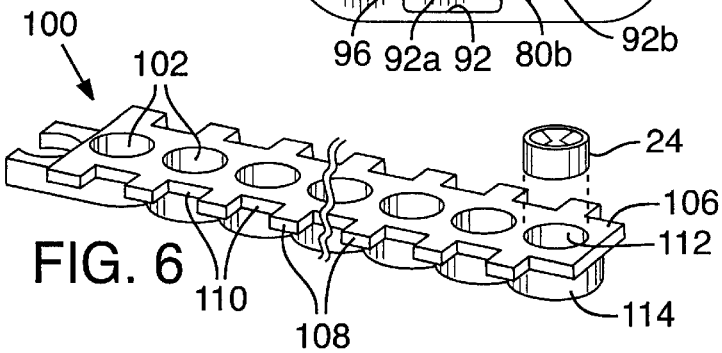
FIG. 6 is a perspective view of a primer holder strip with a primer shown spaced above a primer-receiving receptacle.
Figure 7:
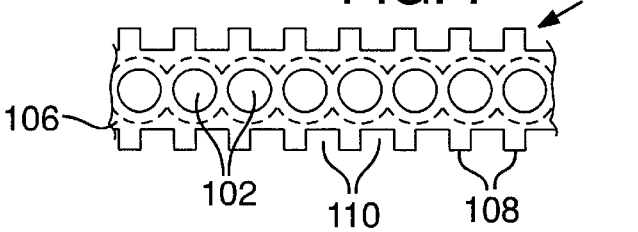
FIG. 7 is a top plan end view of a primer holder strip.

Track 76 is designed to support a generally rectilinear primer strip 100 (as best illustrated in FIGS. 5–7) having a plurality of primer containing receptacles 102, each of which carries a conventional primer 24. The primer as illustrated in FIG. 6 has a substantially cylindrical body, which is press fit into the primer socket at the base of cartridge 20. The primer holding strip is preferably a molded polymeric part, for example, a resinous plastic material. A suitable material for the strip is polypropylene, but other resilient polymeric materials may also be used. In the disclosed embodiment the strip is long and narrow (for example, 12 cm long and 12 mm wide) and shallow (about 4–5 mm deep). Such a strip is further described and disclosed in U.S. Pat. No. 5,719,348 entitled Component Holder For Cartridge Reloading, which is included herein by reference.

Strip 100 includes a substantially planar portion 106 that provides a basic frame having opposing longitudinal edges, from which project a series of longitudinally spaced lateral projections in the form of identical castellations or teeth 108 also referred to herein as engagement portions, that extend in the plane of portion 106. An axis of symmetry runs along the longitudinal axis of the strip, such that each half of the strip (including castellations) are the mirror image of the other half. The teeth 108 form a series of gaps 110 that provide a means of indexing the strip as the strip progresses along the track.

Each receptacle 102 is a substantially tubular member formed by an orifice 1 12 in the strip and a substantially tubular extension 114 depending from the planar portion. The tubular portions of the receptacles form a base lower portion of the strip. Each receptacle 102 holds a corresponding primer 24 in a tight, interference fit, such that the primer is not easily dislodged from the receptacle during transportation, or at any time before it is time to load the primer into the cartridge case primer socket. The interior walls of each receptacle may have flattened areas to improve the interference fit between the primer and receptacle.

The receptacles are substantially equally spaced along the length of the strip. The width of each tooth 108 is about one half the diameter of each receptacle, with one edge of the tooth being substantially aligned with the center of its associated receptacle. The teeth are provided in fixed locations with respect to each receptacle such that the position of a tooth predictably locates its associated receptacle and a desired target location, as will be described in greater detail below.

The strip is loaded into the tool as illustrated in FIG. 1 and 4A by being inserted into track 76 with teeth 108 resting atop rails 80, 82. Depending tubular extensions 114 slide between rails 80, 82 as best illustrated in FIG. 4A. The advancement direction for the strip is indicated by arrow 116 in FIG. 1.

Strip 100 is advanced longitudinally along the track by an advancement, or indexing, member 120 (FIGS. 2–4A) that reciprocally slides along track 76 in an advancing direction 116 and a retracting direction 118. Advancement member 120 includes a rectangular, substantially flat base 122 having longitudinally extending ridges 124, 126, a leading edge 128, and a trailing edge 130. The base 122 has an elongate, longitudinally extending slot 132 formed therein which has enclosed ends.

A forward pair of parallel advancement arms 136*a*, 136*b* incline upwardly from the ridges 124, 126 along the longitudinal edges of advancement member 120, while a pair of rear advancement arms 138*a*, 138*b* also incline upwardly from the longitudinal edges of advancement member 120. The arms 136*a*, 136*b*, 138*a*, 138*b* are inclined upwardly in the advancing direction 116. Each of the arms is inclined at an angle of about 30 degrees to the surface of base 122 and are of equal length. The length of the arms is sufficient to extend above the side ridges along the edges of the advancement member.

The advancement member 120 is supported on lower surface 78 and slides in track 76 for reciprocating movement in the advancing and retracting directions 116, 118, respectively. The range of reciprocation in an advancement direction is limited by arms 138*a*, 138*b* coming into contact with stop elements, such as that indicated at 80*b*. The range of reciprocation of advancement member 122 in the retracting direction is limited by the rear sides of arms 138*a*, 138*b* contacting the forward ends of rail segments 80*a*, 82*a*, and the rear sides of arms 136*a*, 136*b* contacting the forward ends of rail segments 80*b*, 82*b*. The rail segments contact the arms close to their juncture with ridges 124, 126 where minimal or negligible flexing of the arms will occur.

A projection 142 depending from the rear end of advancement member 120 supports an elongate tension spring 146 in a cantilevered position extending rearwardly therefrom as illustrated in FIGS. 1, 3 and 4. As best seen in FIG. 2, the forward end of spring 146 has a hook portion 146*a* which attaches it to projection 142 and at its opposite end has a hook 146*b* which holds a closed-end rivet stop element 150.

An elongate arcuate connecting arm 154 has a bore 156 adjacent one of its ends. This end is received in a slot 158 in the upper portion of handle 14 and is pivotally connected thereto by a bolt 160. The central portion of arm 154 extends through a channel 160 in the upper portion of body 12 underlying track elements 66, 68. The opposite end of arm 154 has an angularly disposed engagement portion 162 formed thereon. The engagement portion has a bore 164 extending therethrough, which has a diameter slightly larger than the diameter of spring 146.

As is best seen in FIGS. 3 and 4, the engagement portion 162 is disposed adjacent the trailing edge 130 of advancement member 120, and receives spring 146 therethrough. The engagement portion is positioned to engage advancement member 120 when in its first position as illustrated in FIG. 3, and when the handle 14 is swung to its second position as shown in FIG. 4, it engages stop element 150. When handle 14 is swung to its first position as illustrated in FIG. 3, engagement portion 162 engages trailing edge 130 of the advancement member to urge it in its advancing direction, to the left in FIGS. 3 and 4. As the handle is swung from its first to its second position as illustrated in FIG. 4, the engagement portion moves some distance to the right before it eventually contacts stop element 150, to tension spring 146. Tensioning of spring 146 in turn urges the advancement member to move in its retracting direction 118, to the right in FIGS. 3 and 4. Spring 54 within the body of the tool urges plunger 48 downwardly which in turn, acting through connecting rod 56, urges handle 14 to swing toward its first position as illustrated in FIG. 3.

A priming station, indicated generally at 166, is provided in the tool in which primers are sequentially transferred from the primer strip 100 to the primer socket in cartridge case 20. Cartridge case holder 18 is positioned over the priming station with bore 36 aligned with an axis of advancement for plunger 48. When the cartridge case is held in holder 18 as illustrated in FIGS. 3 and 4, the primer socket of the cartridge case is aligned above bore 36, slot 132 in the advancement member, and in the line for axial advancement of plunger 48 into the primer station.

In operation, primer strip 100 is placed in track 76 with teeth 108 supported on rails 80, 82 and tubular extensions 114 depending between the rails. Primers 24 have been preloaded into strip 100 in the appropriate orientation for loading into an ammunition cartridge case socket. Cartridge case 20, with an empty primer socket, is slid laterally into holder 18 to be gripped by gripping members 32, 34 and centered above bore 36. A strip 100 is pushed toward the priming station in advancement direction 116 until a receptacle holding a primer is disposed in a target position in the priming station under cartridge case 20. As the primer strip is manually advanced by being pushed along rails 80, 82, teeth 108 slide over and depress advancing arms 136*a*, 136*b*, 138*a*, 138*b* and detent arms 94, 96. When a primer in the strip is properly positioned, as noted by primer 24*a* in FIG. 5, detent arms 94, 96 rest against the rear sides of teeth such as those indicated at 108*a*, 108*b* to prevent movement of the strip in a retracting direction, to the right in FIGS. 3–5.

The tool body 12 is cradled in the user's palm against the pad of the hand and the user's fingers wrap about handle 14. Gripping of the device swings handle 14 from its first position as illustrated in FIG. 3 toward its second, operating position, as illustrated in FIG. 4. As this occurs, connecting arm 56 urges plunger 48 upwardly against the biasing force of spring 54 and plunger head 52 progresses upwardly from its non-operative position illustrated in FIG. 3 to its operating position illustrated in FIG. 4. In this process, the plunger head pushes primer 24*a* out of primer strip 100, seating it in the primer socket at the base of cartridge 20.

As is seen in FIG. 3, engagement portion 162 on connecting arm 154 must be swung some distance to the right from the handle's first position before it engages stop element 150. This produces a delay in the beginning of urging of advancement member in its retracting direction. Once the engagement portion 162 contacts stop element 150 and continues in its movement toward the second position illustrated in FIG. 4, spring 146 is tensioned, which urges advancement member 120 to move in its retracting direction.

The delay mechanism produced by this delay in the engagement portion 162 contacting stop element 150 allows time for the plunger to move upwardly into the primer station through slot 132 in the advancement member.

After the plunger head is sufficiently advanced into the priming station through slot 132 the tensioning of spring 146 urges the advancing member to move to the retracted position illustrated in FIG. 4. As is seen, the rear sides of arms 136*a*, 136*b* contact the front ends of rail segments 80*b*, 82*b* and the rear sides of arms 138*a*, 138*b* contact the front ends of rail segments 80*a*, 82*a* to act as stops to limit retracting movement of the advancement member.

As the advancement member is moved to its retracted position, its advancing arms 136*a*, 136*b*, 138*a*, 138*b* flex downwardly under a set of teeth on the strip and then spring upwardly to move into a following set of gaps 110 between teeth 108 to engage the next set of teeth for advancing of the strip.

After the primer has been set in the cartridge case primer socket, the user releases his grip to allow handle 14 to be swung under the urging of spring 54 from its second position as illustrated in FIG. 4 toward its first position as illustrated in FIG. 3. As this occurs, engagement portion 162 of the connecting arm engages trailing edge 130 of the advancement member to push the advancement member in a sliding movement to move it in its advancement direction, to the left in FIGS. 3 and 4, to the position illustrated in FIG. 3 which advances a subsequent primer into the priming station. Advancement of the advancing member is limited by rear advancing arms 138*a*, 138*b* coming into contact with stop elements such as that indicated at 80*b*, 82*b* in the track member.

The size and location of the teeth 108, gaps 110, and receptacles 112 are such that arms 136, 138 move the advancing member a calibrated distance which indexes the next receptacle into alignment with bore 36 and plunger 48, along the axis of reciprocation of the plunger. The cartridge case 20 with the new primer 24 loaded in its socket is removed from holder 18 and a new cartridge case with an empty socket is placed in the holder with the socket facing the priming station. Subsequent operation of handle 14 transfers the primer from the aligned receptacle into the empty socket of the new case 20.

As the plunger is repeatedly reciprocated by operation of handle 14, strip 100 continues to be incrementally moved forward by the indexing mechanism. Both sets of advancing arms advance the strips as the advancement member moves in the advancing direction, while during movement of the advancing member in the retracting direction, the arms slide underneath the tooth behind each arm, into a succeeding gap.

Strip 100 does not move in the retracting direction when advancement member moves in that direction because detent arms 94, 96 project at an angle toward each other into the gaps between the teeth. The forward angle of the detent arms prevents retraction of the strip. The detent arms are sufficiently flexible, however, to bend away from each other as the primer strip advances to allow movement of the primer strip in the advancement direction.

Figure 8:
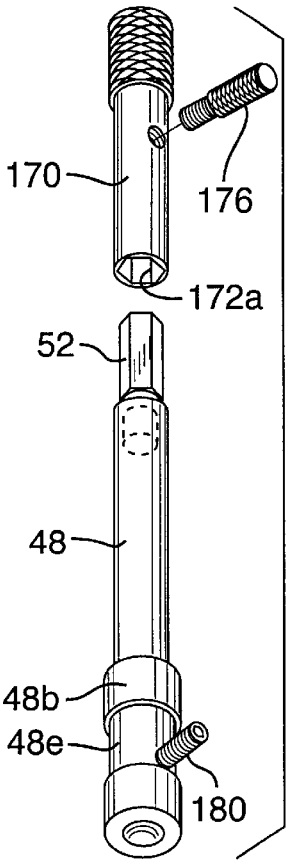
FIG. 8 is a perspective view of a plunger, or pusher, rod and head removed from the tool with a socket wrench spaced thereabove used for attaching and removing the plunger head.
Figure 9:
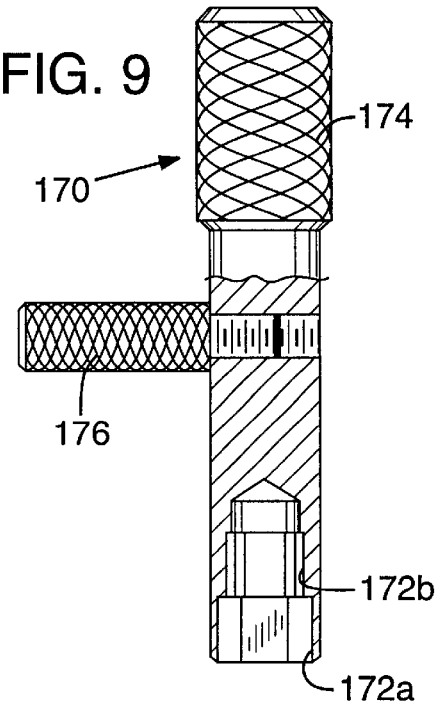
FIG. 9 is an enlarged elevation view of the socket wrench with a lower portion thereof in cross section.

As mentioned previously, plunger head 52 is screwed onto the top end of plunger rod 48. Cartridges of different sizes may require different sized primers, and thus it is necessary to provide different sized plunger heads. Referring to FIGS. 8 and 9, a specialized socket wrench 170 is provided for this purpose. The socket wrench is an elongate cylindrical body having a formed socket at its lower end. The formed socket has a first portion 172*a* with a multi-angular cross-sectional configuration complementary to the multi-angular cross-sectional configuration of a larger plunger head, which may be used in the tool. Spaced inwardly therefrom is a second, smaller cross-sectional multi-angular section 172*b* complementary in shape to the cross-sectional multi-angular configuration of a smaller plunger head, which may be used with the tool also. The upper end of the wrench has a knurled portion 174 for gripping. A side extension 176 may be screwed into a transverse threaded bore to provide added leverage for turning.

Referring to FIGS. 2 and 8, a set screw 180 is screwed into a threaded bore extending from the exterior of the handle to bore 36. As is seen in FIGS. 2 and 8, lower section 48*b* of the plunger has a recessed region 48*e*. When the plunger is moved to its raised, extended, operative position as illustrated in FIG. 4, set screw 180 may be screwed into the bore against recessed region 48*e* to hold the plunger in a raised position and inhibit rotation thereof. With the plunger thus secured in its raised position wrench 170 may be placed on the plunger head to attach or remove the plunger head, or to adjust its vertical position relative to the rod to adjust depth of seating of a primer in the socket.

Having illustrated and described the principles of the invention in its preferred embodiment, it should be apparent to those skilled in the art that the invention can be modified in arrangement and detail without departing from such principles. We claim all modifications coming within the spirit and scope of the following claims.

We claim:

1. A hand-held tool for inserting primers into a cartridge case having a primer socket by transferring a primer from an elongate primer holding strip having a plurality of longitudinally aligned primer receptacles, the tool comprising:

an elongate hand-held body;

a priming station adjacent one end of said body having a holder that holds a cartridge case with the primer socket in a target position for receiving the primer from a target receptacle of the primer holding strip;

a plunger mounted for shifting longitudinally of said body into said priming station to push one of the primers out of the target receptacle into the target position;

an elongate operator handle connected to said body for movement relative to the body between a first position spaced a selected distance from the body and a second position closer to the body when the body and handle are held by the user's hand;

plunger operating mechanism connecting the handle to said plunger for shifting said plunger between a non-operating position outside said priming station when said handle is in its first position to an operating position extending into said priming station when the handle is moved to its second position;

an advancer that incrementally advances the primer holding strip longitudinally through the priming station to sequentially align a series of target receptacles of the primer holding strip with the target position and advancer operating mechanism which interacts with the advancer and the handle to incrementally advance the primer holding strip as the handle is moved between its first and second positions.

2. The tool of claim 1, wherein the primer holding strip comprises a body having projections which interact with the advancer to incrementally longitudinally advance the primer strip holder.

3. The tool of claim 1, which further comprises a spring which urges the handle toward its first position, and said advancer operating mechanism comprises a member coupled to said handle which engages and urges the advancer to move in its advancing direction when the handle is moved from its second to its first position.

4. The tool of claim 3, wherein said advancer operator member comprises an elongate arm connected adjacent one of its ends to said handle and having an engagement portion thereon spaced from said one of its ends for engaging said advancer.

5. The tool of claim 4, wherein said handle is pivotally connected to the body for swinging between said first and second positions.

6. The tool of claim 3, which further comprises a stop element limiting the movement of the advancer in its advancing direction to properly align a target receptacle with the target position.

7. The tool of claim 1, wherein the primer holding strip has engagement portions thereon and the advancer comprises a sliding member in the priming station that reciprocates between an advancing direction and a retracting direction, and the sliding member includes an arm inclined in the advancing direction toward the primer holding strip to engage the engaging portions on the primer holding strip to incrementally advance the primer holding strip as the advancer moves in the advancing direction.

8. The tool of claim 7, which further comprises a detent in the priming station that opposes movement of the primer holding strip with the advancer as the advancer moves in the retracting direction.

9. The tool of claim 7, which further comprises a retractor operator coupled to said advancer to urge the advancer to move in its retracting direction when the handle is moved from its first to its second position.

10. The tool of claim 9, wherein said retractor operator comprises delay mechanism to delay urging of the advancer in its retracting direction until the plunger is shifted into its operating position extending into said priming station.

11. The tool of claim 10, wherein said retractor operator comprises an elongate tension spring connected to the advancer and extending in the retracting direction from the advancer, and said handle comprises means operable to engage said spring and begin to tension the spring in the retracting direction after the handle has moved partially toward its second position sufficient to shift the plunger into its operating position, and upon further swinging of the handle to its second position tensions the spring to urge the advancer to move in its retracting direction.

12. The tool of claim 7, which further comprises stop means operable limit movement of the advancer in the retracting direction.

13. The tool of claim 1, which further comprises an elongate track comprising substantially parallel supports on which the primer holder strip slides into and through the primer station.

14. The tool of claim 1, wherein said plunger comprises an elongate rod which is urged upwardly through said body upon actuation of said handle, and a plunger head screwed onto said rod.

15. The tool of claim 14, wherein said plunger head has a multi-angular cross-sectional configuration which may be gripped by a wrench to attach and remove the plunger head from the rod without the need to remove the rod from the tool.

16. The tool of claim 14, wherein said tool further comprises an elongate socket wrench having an internal configuration complementary to the multi-angular cross-sectional configuration of said plunger head for screwing said plunger head onto and off of said rod.

17. The tool of claim 1, wherein said holder comprises a pair of spaced, opposed, laterally shiftable gripper members having arcuate gripping faces, and spring biasing mechanism yieldably biasing said gripper members toward each other to receive and hold the base of a cartridge case in the target position.

18. A hand-held tool for inserting primers into a cartridge case having a primer socket by transferring a primer from an elongate primer holding strip having a plurality of longitudinally aligned primer receptacles, the tool comprising:

an elongate hand-held body;

a priming station adjacent one end of said body having a holding that holds a cartridge case with the primer socket in a target position for receiving the primer from a target receptacle of the primer holding strip;

a plunger mounted for shifting longitudinally of said body into said priming station to push one of the primers out of the target receptacle into the target position;

an elongate handle pivotally connected to said body for swinging between first and second positions when the body and handle are held by the user's hand;

a spring yieldably urging the handle toward its first position;

plunger operating mechanism connecting said handle to said plunger for shifting said plunger between a non-operating position outside said priming station when said handle is in its first position to an operating position extending into said priming station when the handle is swung to its second position;

an advancer that incrementally advances the primer holding strip longitudinally through the priming station to sequentially align a series of target receptacles of the primer holding strip with the target position, the advancer comprising a sliding member in the priming station that reciprocates between an advancing direction and a retracting direction, the sliding member including an arm inclined in the advancing direction toward the primer holder strip to engage the primer holding strip to incrementally advance the primer holder strip as the advancer moves in the advancing direction; and advancer operating mechanism which interacts with the advancer to incrementally advance the primer holding strip as the handle swings from its second position toward its first position, said advancer operating mechanism comprising an elongate arm connected adjacent one of its ends to said handle and having an engagement portion thereon spaced from said one of its ends for engaging said advancer.

19. The tool of claim 18, which further comprises a retractor operator coupled to said advancer to urge the advancer to move in its retracting direction when the handle is swung from its first toward its second position, and said retractor operator comprises delay mechanism to delay urging of the advancer in its retracting direction until the plunger is shifted into its operatingposition extending into said priming station.

20. The tool of claim 18, which further comprises a detent in the priming station that opposes movement of the primer holding strip with the advancer as the advancer moves in the retracting direction.

21. A hand-held tool for inserting primers into a cartridge case having a primer socket by transferring the primer from an elongate primer holding strip having a plurality of longitudinally aligned primer receptacles, the tool comprising:

an elongate body configured to be held in the user's hand;

a priming station adjacent one end of the body having a holder that holds a cartridge case with the primer socket in a target position for receiving the primer from a target receptacle of the primer holding strip;

an elongate track extending through the priming station transversely of the body for guiding a primer holding strip;

an indexing mechanism that aligns a target receptacle of the primer strip in a punch location aligned with the target position, wherein the indexing mechanism interacts with the primer strip to incrementally advance the primer strip longitudinally along a linear path on the track to sequentially align subsequent target receptacles with the punch location, the indexing mechanism including a sliding member adjacent the track that reciprocates along a path substantially parallel to the track between movement in an advancing direction along the path of movement and in a retracting direction opposite the advancing direction, and an arm projects from the sliding member to engage and advance the primer strip in the advancing direction as the sliding member moves in the advancing direction;

a reciprocating punch member advanceable into the target receptacle in the punch location to move one of the primers from the target receptacle into the primer socket, and then retractable away from the punch location;

an elongate handle pivotally connected to said body for swinging between first and second positions when the body and handle are held in a user's hand; and operating mechanism connecting the handle to the punch for shifting the punch to an operating position extending into the punch location when the handle is swung from its first toward its second position and to allow the punch to retract away from the punch location on swinging of the handle toward its first position, and further interacting between the indexing mechanism and the handle to urge the sliding member to move in an advancing direction when the handle is swung from its second position toward its first position.

22. The tool of claim 21, which further comprises a biasing member which urges the handle toward its first position, and an advancer operator member coupled to the handle which engages and urges the sliding member to move in its advancing direction when the handle is swung from its second toward its first position.

23. The tool of claim 22, wherein the advancer operator member comprises an elongate arm connected adjacent one of its ends to said handle and having an engagement portion thereon spaced from said one end for engaging said sliding member.

24. The tool of claim 21, which further comprises a detent in the primer station that opposes movement of the primer holding strip with the sliding member as the sliding member moves in the retracting direction.

25. The tool of claim 21, which further comprises a retractor operator coupled to said sliding member to urge the sliding member to move in its retracting direction when the handle is swung from its first toward its second positions, and said retractor operator includes delay mechanism operable to delay urging of the sliding member in its retracting direction until the punch is shifted into its operating position.

26. A hand-held primer device for pressing a primer into a primer socket of an ammunition cartridge case, wherein the device comprises:

an elongate hand-held body;

a track having a pair of opposed support ledges extending transversely of the body;

an elongate primer strip having a plurality of primer containing receptacles, and lateral projections extending from at least one longitudinal edge of the primer strip which supports the primer strip on at least one of the opposing support ledges;

a priming station comprising a holder for holding the cartridge case with the primer socket in a loading position;

a sliding member supported for moving reciprocally in an advancing direction and an opposed retracting direction adjacent and parallel to the track, and an arm projecting from the sliding member toward the primer strip to engage the lateral projections and advance the primer strip in the advancing direction along the track when the sliding member moves in the advancing direction;

a detent having an arm that projects toward the advancing direction to engage the lateral projections from the primer strip and oppose movement of the primer strip in a direction opposite the advancing direction when the sliding member moves in the retracting direction;

a plunger mounted to reciprocate longitudinally of the body between a retracted position in which it does not interfere with movement of the primer strip and an advanced position in which the plunger extends into one of the receptacles of the primer strip and toward the primer socket in the cartridge case to load the primer into the socket;

an elongate handle pivotally connected to the body for swinging between first and second positions when the body and handle are held by the user's hand; and operating mechanism coupling said handle to said plunger and to said sliding member for urging said sliding member to move in its advancing direction and the plunger to move to its retracted position when the handle is swung toward its first position, and to urge said sliding member to move in its retracting direction and said plunger to move to its extended position when the handle is swung to its second position.

27. The device of claim 26, which further comprises a spring which urges the handle toward its first position and the operating mechanism comprises an elongate arm coupled at one of its ends to the handle and having an engagement portion thereon spaced from said one end for engaging the sliding member to urge it in its advancing direction when the handle is swung toward its first position.

28. The device of claim 26, wherein said operating mechanism comprises a retractor coupled to said handle to urge the sliding member to move in its retracting direction when the handle is swung from its first to its second positions and said retractor has a delay built in to delay urging of the sliding member in its retracting direction until the plunger is shifted into its advanced position.

* * * * *